United States Patent [19]

Buller

[11] Patent Number: 4,479,367

[45] Date of Patent: Oct. 30, 1984

[54] THERMAL FILTER

[75] Inventor: J. Stanley Buller, Tampa, Fla.

[73] Assignee: Santa Barbara Research Center, Goleta, Calif.

[21] Appl. No.: 334,783

[22] Filed: Dec. 28, 1981

[51] Int. Cl.[3] ..... F25B 19/00

[52] U.S. Cl. ..... 62/514 R; 165/185; 428/450; 428/460; 428/461

[58] Field of Search ..... 62/514 R, 514 JT; 165/185; 428/450, 460, 461

[56] References Cited

U.S. PATENT DOCUMENTS

| | | | |
|---|---|---|---|
| 3,410,110 | 11/1968 | Hoyes | 62/514 R |
| 3,654,377 | 4/1972 | Fleming et al. | 62/514 R |
| 3,711,365 | 1/1973 | Pyle | 428/461 |
| 3,812,002 | 5/1974 | Lurie | 428/461 |
| 3,813,315 | 5/1974 | Valyi | 428/461 |
| 3,851,173 | 11/1974 | Taylor et al. | 62/514 R |
| 3,967,042 | 6/1976 | Laskin et al. | 428/450 |
| 4,118,947 | 10/1978 | Diedrich et al. | 62/514 R |
| 4,189,524 | 2/1980 | Lazzari | 428/450 |
| 4,194,119 | 3/1980 | MacKenzie | 62/514 R |
| 4,324,104 | 4/1982 | Horn et al. | 62/514 R |

*Primary Examiner*—Ronald C. Capossela
*Attorney, Agent, or Firm*—D. W. Collins; W. J. Bethurum; A. W. Karambelas

[57] ABSTRACT

The rate of temperature change of an infrared detector produced by a cooling source in a typical Joule-Thomson cryostat (or other cooling device such as closed cycle cooler) is reduced by interposing a thermal filter between the detector and cooling source. The thermal filter comprises at least two layers of a first material having a good heat conductivity and high heat capacity, such as copper, separated by a layer of a second material having a high thermal resistance, such as an adhesive, e.g., a silicone rubber. The thermal filter of the invention is a thermal analog of an electrical filter which smooths out voltage or current oscillations.

15 Claims, 3 Drawing Figures

THERMAL FILTER

BACKGROUND OF THE INVENTION

1. Field of the Invention

This invention relates to infrared detectors cooled to low temperature in a cryostat, and, more particularly, to minimizing thermal fluctuations of the detector.

2. Description of the Prior Art

In recent years, many devices have been developed which detect electromagnetic radiation in many areas of the spectrum. Particular attention has been given to the development of detectors which provide an output signal when radiation in the infrared portion of the spectrum is received. Characteristically, these detectors function most efficiently when they are cooled to cryogenic temperature, for example, 77° K. Rapid and efficient cooling of the detector is, of course, desirable. Such infrared detectors are used in a diverse variety of application, such as a guidance sensor on a missile which is intended to seek and destroy IR-emitting aircraft, rockets and the like, in night viewing devices, terrain scanning devices as, for example, from a synchronous satellite, and other applications. In any event, the detectors characteristically operate more efficiently when cooled to cryogenic temperatures. One mode of cooling the detectors to low temperature levels is to provide a source of cryogenic fluid such as argon or nitrogen under comparatively high pressure and bleed the cryogenic fluid into an expansion area adjacent the detector heat load, the expansion thereof inducing cooling thereof by virtue of the Joule-Thomson effect.

Over the years, the sensitivity of various infrared radiometers has improved and the use of mercury cadmium telluride detectors has increased. These detectors require, in many cases, an extremely stable detector temperature to function properly. However, when cooling infrared detectors, Joule-Thomson cryostats tend to produce a temperature fluctuation at the detector. Thermal fluctuations are particularly observed in throttling cryostats, which turn on and off as necessary to meet demand for cryogenic fluid. Most important to a number of applications is the rate of temperature change of the detector. Devices which have a relatively low frequency response will interpret detector temperature changes at rates higher than a certain threshold (which is determined by the low frequency response) as infrared radiation signals.

Attempts to reduce the rate of temperature change produced by typical Joule-Thomson cryostats (or other cooling devices such as closed cycle coolers) have involved thermophonic dampers which utilize only an increased mass, resulting in an increased thermal inertia. Such dampers, however, require an undesirable increased cool down time. Thermophonic dampers which utilize only an increased thermal resistance have also been employed. However, such dampers have increased detector temperature penalties associated therewith, including significantly reduced cool-down times and increased shock and vibration vulnerability to the package.

SUMMARY OF THE INVENTION

In accordance with the invention, a thermal filter is provided for reducing temperature fluctuations of the detector. The thermal filter of the invention reduces the amplitude and rate of change of the temperature fluctuation. The thermal filter comprises at least two layers of a first material having a good heat conductivity and high heat capacity separated by a layer of a second material having a high thermal resistance. The thermal filter of the invention is a thermal analog of an electrical filter which smooths out voltage or current oscillations.

In practice, the thermal filter is mounted between the detector and the source of cooling. The thermal filter reduces the rate of temperature change produced by typical Joule-Thomson cryostats without suffering the penalties of greatly increased cool down time or increased detector temperature, associated with thermophonic dampers of the prior art. The lower mass of the thermal filter will reduce stress under high g environments of shock and vibration.

DETAILED DESCRIPTION OF THE INVENTION

Figure 1:
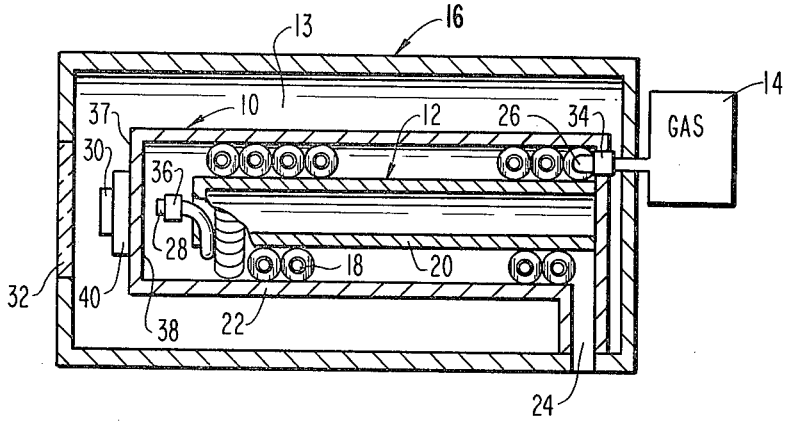
FIG. 1 is a longitudinal section through a conventional cryostat which incorporates the thermal filter of the invention.

There are many types of low temperature refrigerators suitable for cooling infrared detectors. One such type of refrigerator utilizes the Joule-Thomson effect, in which a gas, e.g., nitrogen, argon, Freon 14, oxygen, etc., under high pressure is passed through a throttling valve. The expanded gas cools and is passed back (heat exchanged) over the inlet tube, thereby further cooling the unexpanded gas. Successive cooling eventually causes condensation of the gas. For exemplary purposes only, a low temperature refrigerator utilizing the Joule-Thomson effect is depicted in FIG. 1. However, it will be appreciated that other types of low temperature refrigerators, including closed cycle refrigerators, utilizing other effects (e.g., Claude, Stirling, etc.) may also be employed in the practice of the invention. Further, quick cooling cryostats, such as those employing a Simon expansion tank, may also be employed.

The most efficient user of the compressed gas supply in a system employing a Joule-Thomson cryostat is an apparatus in which the flow of gas is controlled at the exhaust end of the heat exchanger to prevent over-cooling and thus waste (known as a demand flow cryostat). This highly desirable regulating feature, however, is the source of temperature fluctuations, which tends to reduce the effectiveness of the apparatus in some applications.

Shown in FIG. 1 is a conventional open cycle cryostat, which comprises a cold finger 10 and a Joule-Thomson cryostat 12 supplied from a source of high pressure gas 14. Insulation 13 is typically provided, and may comprise a vacuum or insulative material, as is well-known in the art. The cold finger and cryostat assembly are mounted within dewar 16.

Joule-Thomson cryostat 12 comprises a finned tube 18 wound on mandrel 20. The coiled finned tube fits within housing 22 so that out-flowing exhaust gas flows among the fins on tube 18. Exhaust 24, from the warm end of the cold finger, is directed to atmosphere, which provides the lowest practical convenient exhaust pressure.

Finned tube 18 has an inlet 26 at the warmer end and an outlet 28 at the cold end. The inlet communicates with the source of high pressure gas 14. The outlet acts as a nozzle in the final Joule-Thomson expansion. The cold gas expanding from the outlet nozzle 28, which may contain some liquid, depending upon the refrigerant gas, temperatures, pressures and heat loads, is directed for the closest thermal communication with device 30 to be cooled. Gas flow is suitably regulated by valves 34 or 36. Cold finger 10 and device 30 are protected by a suitable insulation 13, preferably against both radiant and conductive heat, in conjunction with dewar 16, as is conventional. When device 30 requires optical access, window 32, of suitable optical properties, can permit the optical access. In many cases, the device 30 is an infrared sensitive detector and thus window 32 and other optics are suitably transparent thereto.

In accordance with the invention, a thermal filter 40 is provided. The thermal filter is adjacent the detector; more specifically, the thermal filter is interposed between the detector 30 and the cooling means. Thus, the thermal filter may be interposed between the detector and cold finger 10, as shown, mounted on outside surface 37. Alternatively, the thermal filter may be mounted on the inside surface 38 of the cold finger, in which case, the detector would be mounted directly on the outside surface 37.

Figure 2:
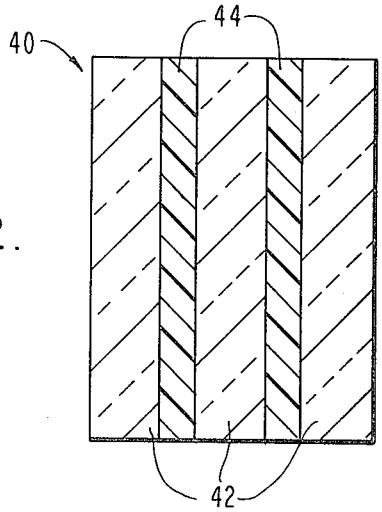
FIG. 2 is a cross-section of the thermal filter of the invention.

The thermal filter of the invention comprises at least two layers of a first material having a good heat conductivity and high heat capacity separated by a layer of a second material having a high thermal resistance. As shown in FIG. 2, which is a cross-section of a thermal filter of the invention (not to scale), three layers of the first material 42 are separated by two layers of the second material 44. The first material preferably comprises copper, while the second material comprises a suitable adhesive such as a silicone rubber, an epoxy cement or the like. As an example, the thermal filter may comprise three copper disks about 0.010 to 0.015 inches in thickness and the second material may comprise RTV silicone rubber about 0.001 to 0.005 inches in thickness.

Figure 3:
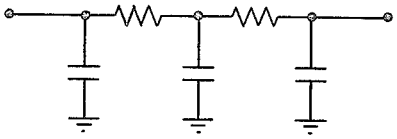
FIG. 3 is an equivalent electrical circuit analog of the thermal filter of FIG. 2.

The thermal filter of the invention is a thermal analog of an electrical filter which smooths out voltage or current oscillations. In this case, the first material is a thermal analog of a capacitor, while the second material is a thermal analog of a resistor. The equivalent electrical filter analogous to the thermal filter shown in FIG. 2 is depicted in FIG. 3. A fluctuating temperature input is smoothed out by the thermal filter of the invention. Accordingly, the amplitude and rate of change of temperature fluctuation is reduced.

The thermal filter may comprise any number of layers of the first material separated by layers of the second material, so long as the sandwich structure begins and ends with a layer of the first material. In order to minimize thermal resistance, the second material is necessarily thin. Attachment of the thermal filter to both the cold finger and detector is conveniently achieved by means of an adhesive. Alternatively, spring loaded means or equivalent mechanisms may be employed to maintain the thermal filter in direct mechanical contact with the cold finger and/or detector. The avoidance of adhesives in such an alternative configuration eliminates additional thermal resistive elements which could have an effect on the performance of the thermal filter which would be difficult to calculate for specific situations.

EXAMPLE

For a conventional cryostat having a 10° temperature fluctuation at 87° K operation, a thermal filter comprising three copper disks 0.010 inches thick separated by silicone cement 0.005 inches thick was placed on the inside portion (surface 38) of the cold finger. The thermal fluctuation was reduced to about 0.25° C. with rounded temperature peaks.

What is claimed is:

1. A thermal filter for reducing temperature fluctuations of a detector produced by a cryostat which comprises at least two layers of a first non-porous material comprising copper disks about 0.010 to 0.015 inches thick separated by a layer of a second material comprising an adhesive about 0.001 to 0.005 inches thick.

2. The thermal filter of claim 1 comprising three layers of said first material separated by two layers of said second material.

3. The thermal filter of claim 1 in which said second material comprises a silicone rubber.

4. A method for reducing temperature fluctuations of a detector maintained in a dewar and cooled by a cryostat, which comprises providing a thermal filter adjacent the detector, the thermal filter comprising at least two layers of a first non-porous material having a good heat conductivity and high heat capacity separated by a layer of a second material having a high thermal resistance.

5. The method of claim 4 comprising three layers of said first material separated by two layers of said second material.

6. The method of claim 5 in which said first material comprises copper and said second material comprises an adhesive.

7. The method of claim 6 in which said first material comprises copper disks about 0.010 to .015 inches thick and said second material comprises a silicone rubber about 0.001 to 0.005 inches thick.

8. In combination, a cryostat including (a) a cold finger;

(b) means for cooling the cold finger to cryogenic temperatures; and (c) a detector mounted on the outside of the cold finger, characterized in that a thermal filter is interposed between the detector and the cooling means, the thermal filter comprising at least two layers of a first material having a good heat conductivity and high heat capacity separated by a layer of a second material having a high thermal resistance.

9. The combination of claim 8 comprising three layers of said first material separated by two layers of said second material.

10. The combination of claim 9 in which said first material comprises copper and said second material comprises an adhesive.

11. The combination of claim 10 in which said first material comprises copper disks about 0.010 to 0.015 inches thick and said second material comprises a silicone rubber about 0.001 to 0.005 inches thick.

12. In combination, a detection assembly comprising (a) a cold finger;

(b) means for cooling the cold finger to cryogenic temperatures;

(c) a detector mounted on the outside of the cold finger; and (d) a dewar surrounding the cold finger and provided with a window operably associated with the detector and transparent to radiation capable of being detected by the detector, characterized in that a thermal filter is interposed between the detector and the cooling means, the thermal filter comprising at least two layers of a first material having a high heat conductivity and high heat capacity separated by a layer of a second material having a high thermal resistance.

13. The combination of claim 12 comprising three layers of said first material separated by two layers of said second material.

14. The combination of claim 13 in which said first material comprises copper and said second material comprises an adhesive.

15. The combination of claim 14 in which said first material comprises copper disks about 0.010 to 0.015 inches thick and said second material comprises a silicone rubber about 0.001 to 0.005 inches thick.

* * * * *